United States Patent [19]

Ueda

[11] 4,350,860

[45] Sep. 21, 1982

[54] HEATING APPARATUS WITH SENSOR

[75] Inventor: Shigeki Ueda, Nara, Japan

[73] Assignee: Matsushita Electric Industrial Co., Ltd., Osaka, Japan

[21] Appl. No.: 178,935

[22] Filed: Aug. 18, 1980

[30] Foreign Application Priority Data

| | | | |
|---|---|---|---|
| Aug. 17, 1979 | [JP] | Japan | 54/105317 |
| Aug. 20, 1979 | [JP] | Japan | 54/106331 |
| Aug. 20, 1979 | [JP] | Japan | 54/114896[U] |
| Aug. 20, 1979 | [JP] | Japan | 54/114897[U] |

[51] Int. Cl.[3] ..... H05B 9/06; H05B 1/02

[52] U.S. Cl. ..... 219/10.55 B; 219/492; 219/506; 340/384 E; 340/692

[58] Field of Search ..... 219/492, 493, 10.55 B, 219/506; 340/692, 602, 596, 540, 500, 384 E, 27 SS

[56] References Cited

U.S. PATENT DOCUMENTS

| | | | |
|---|---|---|---|
| 3,298,010 | 1/1967 | Dubosq et al. | 340/692 |
| 3,582,949 | 6/1971 | Forst | 340/692 |
| 3,998,045 | 12/1976 | Lester | 58/23 R |
| 4,016,540 | 4/1977 | Hyatt | 364/900 |
| 4,097,707 | 6/1978 | Kobayashi et al. | 219/10.55 B |
| 4,107,464 | 8/1978 | Lynch et al. | 340/692 |
| 4,135,143 | 1/1979 | Argentieri et al. | 340/27 R |
| 4,158,759 | 6/1979 | Mason | 219/10.55 B |
| 4,209,836 | 6/1980 | Wiggins, Jr. et al. | 340/718 |
| 4,209,844 | 6/1980 | Brantingham et al. | 364/724 |

FOREIGN PATENT DOCUMENTS

| | | | |
|---|---|---|---|
| 957 | 3/1979 | European Pat. Off. | 219/10.55 B |
| 54-2098 | 1/1979 | Japan | 340/692 |
| 54-153357 | 12/1979 | Japan | 219/10.55 B |

*Primary Examiner*—B. A. Reynolds
*Assistant Examiner*—M. H. Paschall
*Attorney, Agent, or Firm*—Spencer & Kaye

[57] ABSTRACT

Heating apparatus equipped with a sensor element for sensing or estimating the state of a substance being heated, for example, a temperature probe containing a temperature sensor such as a thermistor in one end of a metal tube or a humidity sensor sensitive to vapor emanating from the substance being heated. Information data relating to the handling of such a sensor element or instructing an appropriate heating sequence or process selected on the basis of the sensed state of the substance being heated is selectively read out from a voice data memory to be synthesized into voice information in a voice synthesizer such as a PARCOR synthesizer, and the voice information is announced to the user at a predetermined time. The user hearing the message can therefore manipulate the apparatus in such a way as to compensate for the inherent defect of the sensor element, and even a menu requiring a very delicate procedure can be successfully cooked without any heating failure.

6 Claims, 15 Drawing Figures

HEATING APPARATUS WITH SENSOR

BACKGROUND OF THE INVENTION

This invention relates to a heating apparatus equipped with a sensor element such as a humidity sensor, for controlling the heating.

Conventional heating apparatus, for example, high-frequency heating apparatus such as a microwave oven exhibit such operational difficulties that the duration of heating of a substance to be heated is variable depending on the amount of the substance. A heating failure such as overheating or non-uniform heating tends to occur unless the high-frequency output level is suitably switched over depending on the kind of substance to be heated. In view of the above operational difficulties, automation of the heating apparatus has been attempted in which the heating duration and the high-frequency output level are not preset, and a sensor element such as a temperature sensor, an infrared sensor or a humidity sensor is employed for automatically sensing the time to terminate the heating process. However, in view of the fact that these sensors have individual advantages and disadvantages, the user had to manipulate the apparatus in such a way as to suitably compensate for the disadvantage of the sensor employed in the apparatus.

In the case of, for example, a temperature probe containing a temperature sensor in one end of a rod-like metal tube, it has the advantage of successfully sensing the temperature of an inner central portion of a substance being heated although it is most difficult to sufficiently heat that portion. On the other hand, the temperature probe is not effective in sensing non-uniform heating of the substance, and a heating failure tends to occur in which the surface portion of the substance has been carbonized when the temperature of the inner central portion of the substance attains the desired level. Further, the selection of the area of the substance into which the temperature probe is to be inserted is still left as one of the key points in achieving successful cooking.

In contradistinction to the temperature probe, an infrared sensor can merely sense the surface temperature of a substance being heated, and it is indispensable to estimate the heating duration on the basis of the amount of the substance to be heated. Thus, automation is difficult more or less although the fact that this sensor is a non-contact type of sensor is attractive.

A humidity sensor senses primarily water vapor generated from a substance being heated. The result of humidity sensing by the humidity sensor is free from appreciable errors since a large amount of water vapor is not generated until both the temperature of the surface portion of the substance and the temperature of the inner central portion rise up to a certain level. However, unless the relative humidity of the air in the heating chamber of the apparatus varies greatly, the humidity sensor does not accurately sense the time of vapor generation, and the heating will continue without ending. It is therefore essentially necessary to hermetically cover the substance with a wrap of plastic film or like material. When the vapor pressure within the wrap covering the substance attains a level higher than a certain level, the vapor blows out into the heating chamber by thrusting through the wrap, and the relative humidity of air in the heating chamber varies greatly. In that state, the function of the heating sequence control by the humidity sensor is attained with higher reliability.

FIG. 1 is a graph illustrating the effect of such a wrap, by way of example. In FIG. 1, the broken curve A represents the relative humidity of air in the heating chamber when the wrap is not provided, while the solid curve B represents the relative humidity when the wrap is provided. Water vapor starts to generate from the substance at time $T_n$. Till that time $T_n$, the relative humidity shows a decreasing tendency since there is neither increase nor decrease in the absolute quantity of humidity of air in the heating chamber, and on the other hand, the internal temperature of the heating chamber is increasing steadily. When the substance is not covered with the wrap, a slight quantity of vapor emanates locally but continuously from the surface of the substance resulting in a slow but gradual increase in the relative humidity of air in the heating chamber. Therefore, the variation $\Delta H_A$ of relative humidity between time $T_n$ and time $(T_n+\Delta T)$ is not so large. When the humidity sensor is used for the purpose of heating sequence control, therefore, it is indispensable to cover the substance such as a foodstuff with the wrap of plastic film or like until the vapor generation time $T_n$ is reached. However, the finished state of the foodstuff heated while being covered with the wrap is analogous to that of a steamed foodstuff, and it is necessary to remove the wrap at the time $T_n$ when it is desired that the food, such as a roast, have a crisp finish.

The individual sensors have thus individual advantages and disadvantages, and the user of the apparatus had to master the way of skillfully handling the apparatus which is equipped with one of the sensors having such advantages and disadvantages.

It is the object of the present invention to provide a heating apparatus having a voice synthesizer system which is capable of announcing to the user instructions or advice by a voice message at the proper times on the basis of data output from a sensor such as a humidity sensor.

SUMMARY OF THE INVENTION

In a heating apparatus according to the present invention there is provided voice information generating means so that the apparatus itself can provide necessary voice information at predetermined times to announce to the user the instructions or advice of a specific heating procedure to be carried out by the apparatus, and so that failure-free heating can be attained without requiring constant attendance of the user by the side of the apparatus when he is making the necessary manipulations on the basis provided by the advice of the apparatus at the key points of the heating sequence.

Messages provided by the voice information include those on the basis of which the user manipulates the apparatus to cover the inherent defect of the sensor element and those which make possible successful heating of a difficult menu for which a very delicate heating procedure has been required and which has frequently failed without the skill of cooking.

DETAILED DESCRIPTION OF THE PREFERRED EMBODIMENT

Figure 2:
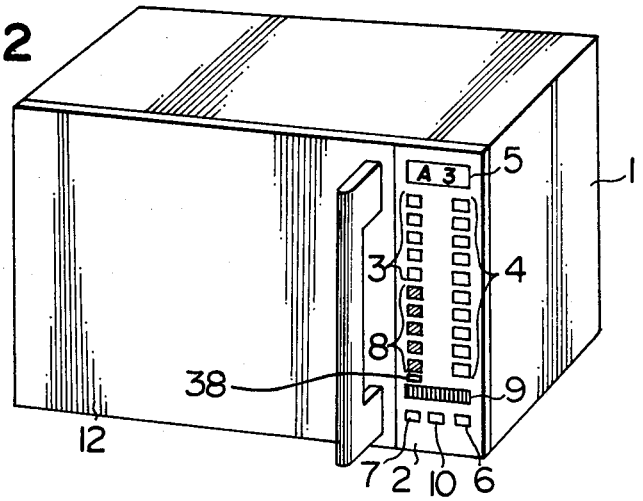
FIG. 2 is a perspective view of a high-frequency heating apparatus equipped with a humidity sensor to show an embodiment of the present invention.
Figure 3:
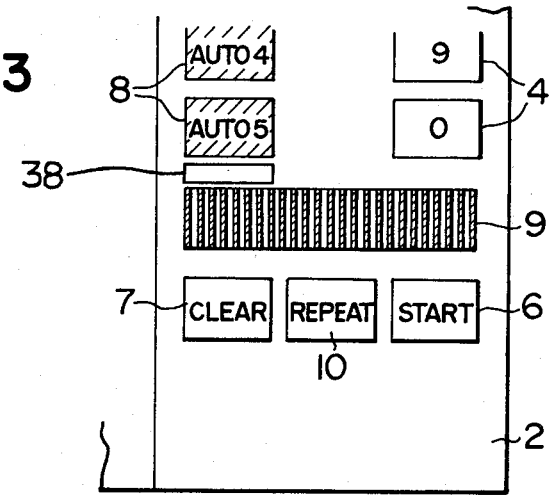
FIG. 3 is an enlarged detail view of part of FIG. 2.

Referring now to the drawings, FIG. 2 is a perspective view of a high-frequency heating apparatus such as a microwave oven equipped with a humidity sensor to show an embodiment of the present invention, and FIG. 3 is an enlarged detail view of part of FIG. 2.

Referring to FIGS. 2 and 3, the microwave oven includes a casing 1 having a manipulator panel 2 disposed on its front wall. The manipulator panel 2 includes five output keys 3 for setting different output levels respectively, ten numeric character keys 4 for setting different heating durations respectively, a display 5 for displaying display data in a manner which will be described later, a start key 6 for instructing starting of a heating sequence, a clear key 7 for clearing a program selected by the user, five automatic cooking select keys 8 according to the present invention and a slitted panel portion 9 for transmitting a synthesized voice message from a speaker to the outside of the microwave oven.

The automatic cooking select keys 8 are used to select five different kinds of heating sequences. In each of these heating sequences, the length of time $T_n$ required for generating vapor from a substance being heated is calculated or counted in a control unit and is then multiplied by a pre-selected constant R to find the remaining length of time of the required heating duration. This is because the length of time $T_n$ differs depending on the amount of the substance to be heated. On the basis of the above fact, the amount of the substance being heated is estimated by calculation, and the remaining length of time of required heating duration as well as the required high-frequency output level is automatically set to meet the selected heating sequence. Thus, when for example, a substance is to be re-heated, application of heat may be terminated upon sensing generation of vapor from the substance, since the substance has already been heated before it is re-heated. In such a case, therefore, the heating duration selected by the manipulation of the re-heat key "AUTO 1" is $T_n$. Similarly, the heating sequences for meat and vegetables are suitably determined, that is, the constant R is suitably determined depending on the foodstuff. The automatic cooking select keys 8 can thus select five different heating sequences respectively. (For details, reference is made to U.S. Pat. No. 4,097,707 issued to Kobayashi, Kanazawa and Tsuboi, and assigned to Matsushita Electric Industrial Co., Ltd.)

The manipulator panel 2 is further provided with a repeat key 10 which is manipulated by the user when the user who has missed hearing the announced message of the synthesized voice wants to hear it again.

The structure of the system according to the present invention will be described with reference to FIG. 4.

Figure 1:
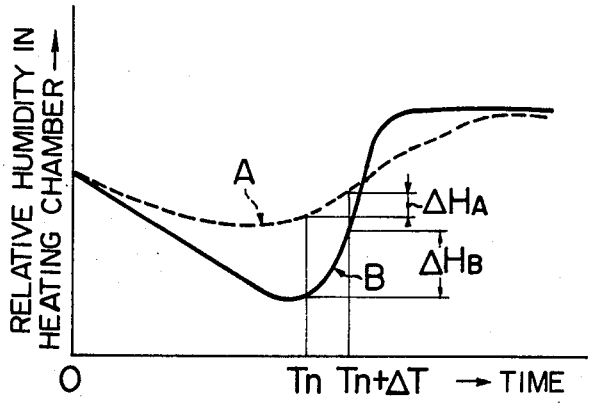
FIG. 1 is a graph showing variations, relative to time, of the relative humidity of air in a heating chamber.
Figure 4:
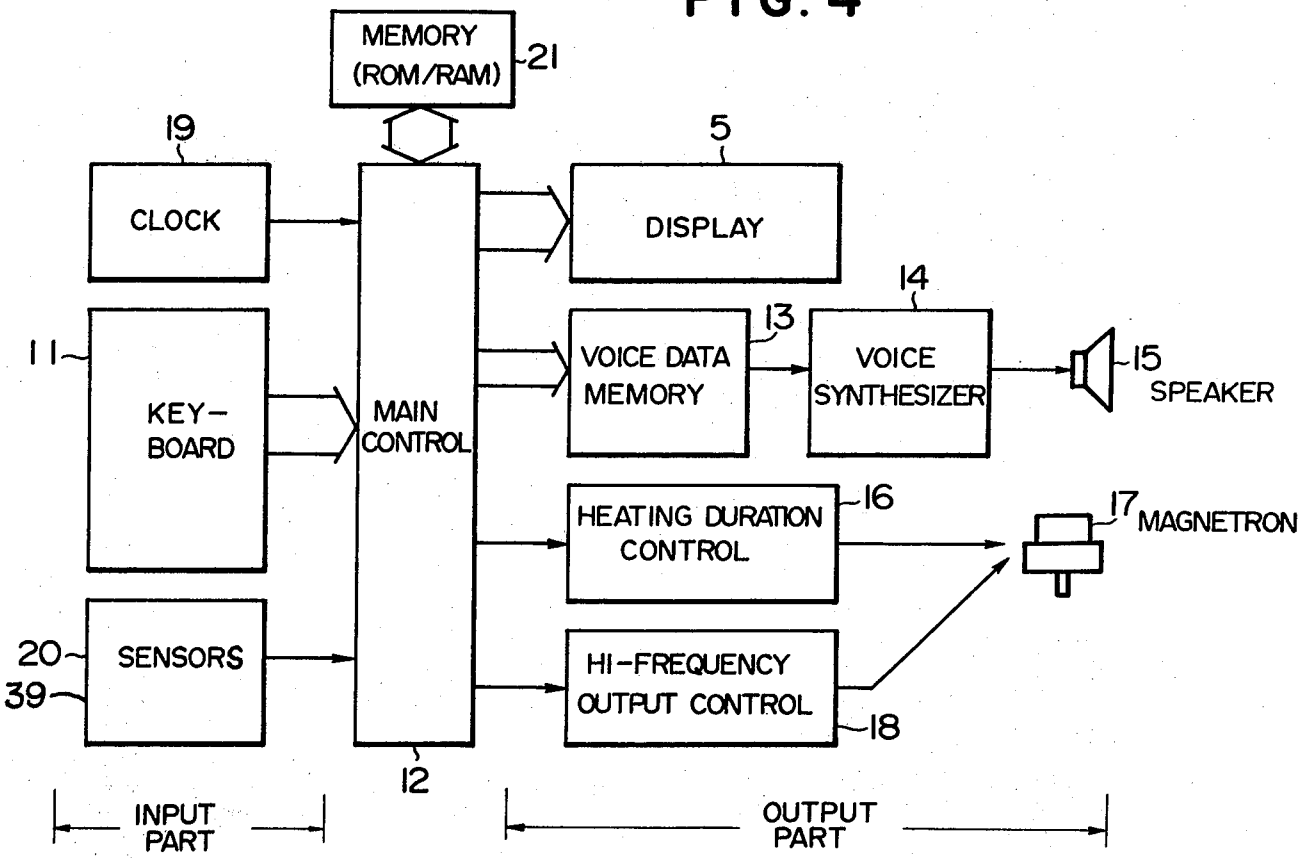
FIG. 4 is a system block diagram of the apparatus according to the present invention.

Referring to FIG. 4, various manipulation commands generated by manipulation of the various keys on the manipulator panel 2 by the user are applied from the keyboard 11 to a main control unit 12. The main control unit 12 decodes such manipulation commands applied from the keyboard 11 to place the entire system in one of a plurality of predetermined modes depending on the combination of the keys manipulated by the user. When, for example, the automatic cooking select key "AUTO 3" is depressed, a data "A 3" is displayed on the display 5, and the system is placed in a heating stand-by mode in which the system is ready to operate in response to the depression of the start key 6. At the same time, the main control unit 12 applies voice address data to a voice data memory 13 so as to read out the corresponding voice data from the memory 13 and to apply the same to a voice synthesizer unit 14. The voice data read out in this case represents "COVER FOOD", and this voice data is synthesized into a corresponding electrical signal by the voice synthesizer unit 14 to be then announced as the voice message "COVER FOOD" from a speaker 15. Hearing this voice message, the user knows that the foodstuff must be covered with a plastic wrap or a saucer or like plate which can hermetically cover the foodstuff. Thus, by hearing this message, the user can prevent the heating failure described by reference to the curve A in FIG. 1 referred to in the background of the invention.

Then, when the start key 6 is depressed, the system is placed in a heating sequence control mode under control of the main control unit 12. In this mode, a heating duration control unit 16 is actuated to start supply of power to a magnetron 17 so that radiation of microwave energy toward and into the heating chamber of the microwave oven is started. Also, data such as, for example, that used for the intermittent control of the power supply is applied to a high-frequency output control unit 18 so that a predetermined high-frequency output level can be established.

As soon as the heating sequence is started, the main control unit 12 starts to count clock pulses which are applied from a clock 19 and are synchronous with the power supply frequency of 50 or 60 Hz. At the same time, the main control unit 12 checks the humidity level applied from a humidity sensor 20.

Figure 5A:
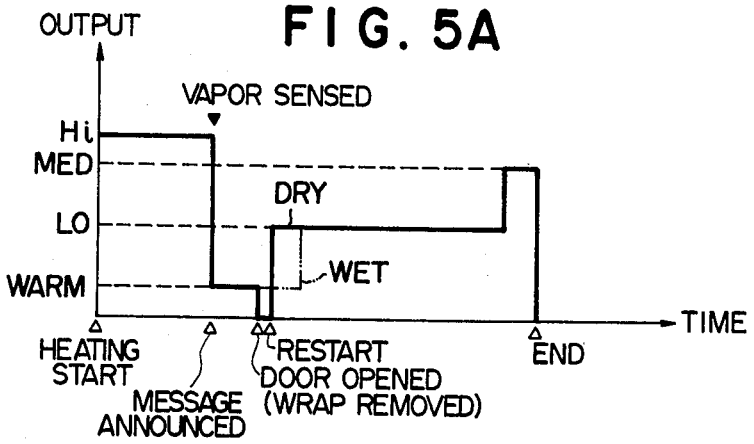
FIGS. 5A and 5B illustrate a specific heating sequence, by way of example.
Figure 5B:
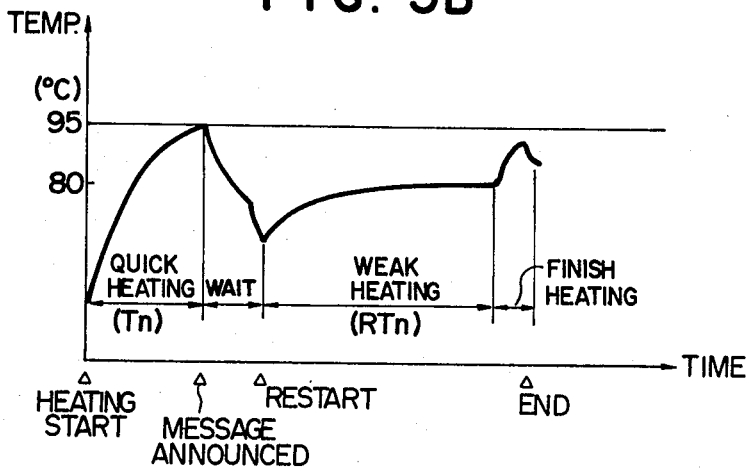

FIGS. 5A and 5B show, by way of example, a heating sequence for the automatic cooking of meat using such a humidity sensor 20. FIG. 5A illustrates how the high-frequency output of the magnetron 17 is switched over under control of the main control unit 12, and FIG. 5B illustrates variations in the internal temperature of the meat being heated. In the initial stage, the meat is quickly heated up to about 90° C. to 100° C. under application of a high output "Hi". The humidity sensor 20 senses generation of vapor after the length of time $T_n$ of the heating duration has elapsed, and this length of time $T_n$ is calculated by counting the clock pulses applied from the clock 19. Then, the remaining length of time $RT_n$ of heating duration is calculated by the main control unit 12, and this data is preset in the heating duration control unit 16.

The length of time $T_n$ is calculated when the humidity sensor 20 senses generation of vapor from the meat. At this time, a voice message "RELEASE PLASTIC WRAP IF DRY" is announced according to a procedure similar to that above described. Upon announcement of this message, the high-frequency output level is reduced to a lower output level "WARM". This output level is maintained until the plastic wrap is removed so as to prevent an excessive drop of the temperature of the meat. After the plastic wrap is removed, the heating sequence is re-started at a low output level "Lo", and this output is continuously applied to avoid non-uniform heating of the meat.

If the user desires a wet finish instead of a dry finish, the plastic wrap need not be removed. In such a case, the heating sequence is represented by an imaginary curve "WET" shown in FIG. 5A. In other words, unless the oven door is opened within the period of time "WAIT" of, for example 1 minute after the announcement of the message "RELEASE PLASTIC WRAP IF DRY", the main control unit 12 judges that the user desires a wet finish and switches over the high-frequency output level to the low output level "Lo" before the heating sequence is re-started.

When the heating sequence is nearly completed, heat at a medium output level "MED" is applied to the meat for a short length of time for the purpose of final finish heating.

All of such heating sequences are stored in a ROM part of a memory 21, and a suitable one of them is read out from the ROM part under control of the main control unit 12. The data including the counted time $T_n$ are also stored in a RAM part of this memory 21.

A periodically changing sound data is stored in the voice data memory 13 to be read out to provide an audible alarm (a buzzer signal) generated from the speaker 15. This audible alarm appears prior to the announcement of messages including the aforementioned messages "COVER FOOD" and "RELEASE PLASTIC WRAP IF DRY". This is effective in preventing surprise of the user who suddenly hears the message or preventing mishearing of the message by the user, since the various messages are sequentially announced at predetermined timing. Thus, the user's attention is attracted to the microwave oven when the user hears the alarm. This audible alarm is utilized also as a conventional buzzer signal which indicates the end of a heating sequence.

In spite of such an arrangement, there is still left a possibility of mishearing such a message. This possibility is quite high when the microwave oven is placed in a noisy environment or when the user stands remote from the microwave oven. The message announced immediately before can be repeatedly heard when the address of the voice data for the specific message is stored in the RAM part of the memory 21 so that the address can be repeatedly re-applied by the depression of the repeat key 10.

Figure 6:
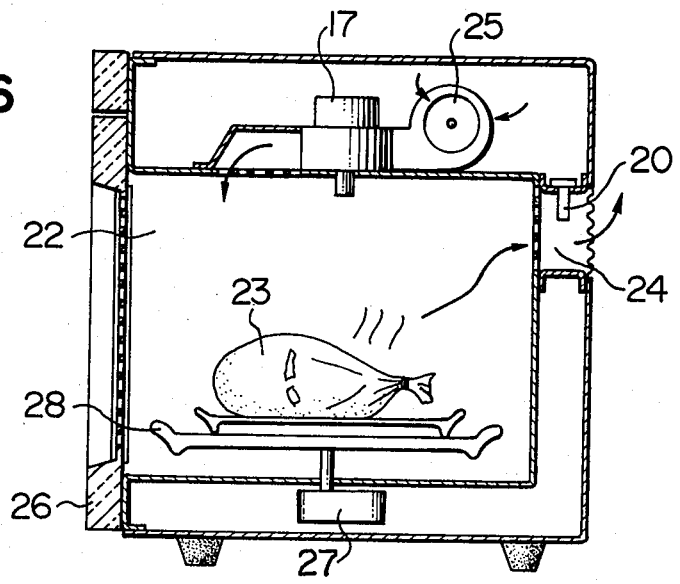
FIG. 6 is a schematic sectional view of the apparatus according to the present invention.

FIG. 6 shows the heating chamber of the microwave oven in section. Referring to FIG. 6, a foodstuff 23 to be heated is placed within the heating chamber 22, and the microwave is directed toward the foodstuff 23 from the magnetron 17. The humidity sensor 20 is disposed in an air guide 24. The electrical resistance value of the sensor 20 varies greatly depending on the relative humidity of the oven ventilating stream of air supplied by a cooling fan 25 for ventilating the interior of the heating chamber 22 after cooling the magnetron 17. The numeral 26 designates the oven door, and the numeral 27 designates a motor which causes rotation of a foodstuff carrier plate 28 so as to prevent non-uniform heating of the foodstuff 23.

A practical form of the circuitry employed in the embodiment of the present invention will now be described with reference to FIG. 7.

The various keys disposed on the manipulator panel 2 are scanned with scanning signals $SC_4$ to $SC_1$ and constitute a key matrix 11 which is connected to input ports $IN_7$ to $IN_2$ of a microcomputer 29 which functions as the main control unit 12. Further, a door position information signal from a door switch 30 sensing the open-close position of the oven door 26 is applied to an input port $IN_1$ of the microcomputer 29. A humidity information signal from the sensor 20 sensing the relative humidity of air in the heating chamber 22 is applied through a comparator 31 to another input port $IN_0$ of the microcomputer 29. A powersupply frequency synchronous signal 19' providing timer decrement pulses for controlling the heating duration control unit 16 is applied to a 50/60 Hz port of the microcomputer 29.

The scanning signals $SC_4$ to $SC_1$ act, together with another scanning signal $SC_0$, to dynamically energize the 5-digit display 5. Data to be displayed appears as segment signals $Seg_7$ to $Seg_0$ connected to the display 5. The door switch 30 is also inserted in the main circuit as indicated by 30' so as to directly control the power supplied to the magnetron 17. The symbols TC and PC designate a heating duration control signal and a high-frequency output control signal respectively. It is the output control unit 18 which is intermittently controlled by the output control signal PC and acts to vary the average output of the magnetron 17.

In operation, when one of the automatic cooking select keys 8 is selected and depressed, the microcomputer 29 reads out the corresponding one of the predetermined heating sequences from its own ROM part and presets that sequence in the predetermined memory area or register in its RAM part. Thus, the memory 21 shown in FIG. 4 and the main control unit 12 shown also in FIG. 4 are realized by the microcomputer 29 shown in FIG. 7.

The voltage level of the output signal from the sensor 20 indicative of its electrical resistance value is compared in the comparator 31 with 5-bit digital reference signals $Ref_4$ to $Ref_0$ applied from the microcomputer 29. A switching element 32 such as a C-MOS inverter acts, together with a ladder network 33, to convert the digital reference signals $Ref_4$ to $Ref_0$ into an analog quantity or data.

Figure 7:
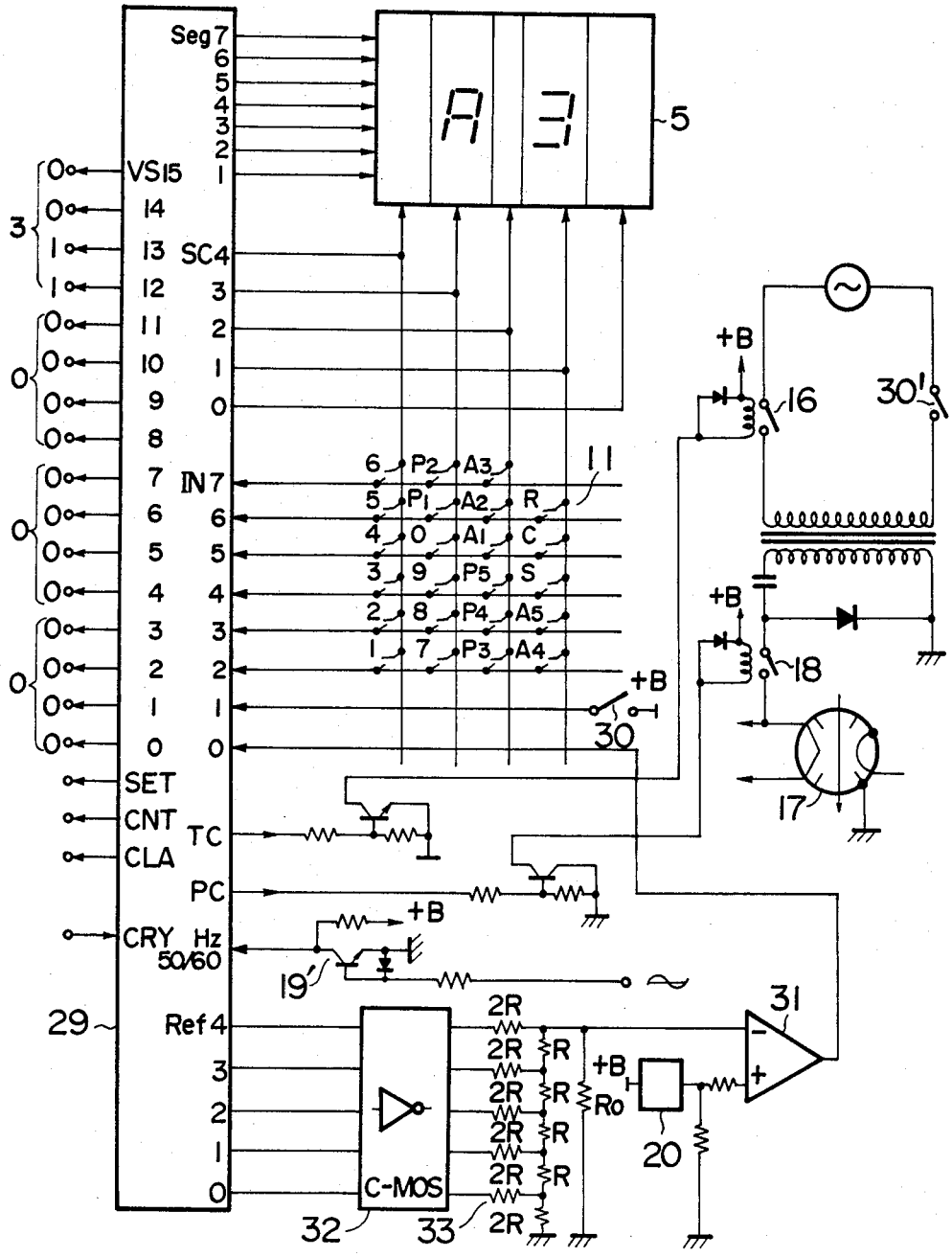
FIG. 7 is a practical circuit diagram of the system shown in FIG. 4.

After the heating sequence on the foodstuff 23 is started, the output signal from the humidity sensor 20 indicative of the relative humidity of air in the heating chamber 22 of the microwave oven is applied continuously to the microcomputer 29 through the comparator 31 in the system having the structure shown in FIG. 7. On the basis of such sensor data and clock data, the proper cooking steps are sequentially announced by the voice messages. When, for example, automatic cooking of meat is selected, and generation of vapor from the meat is sensed upon lapse of the length of time $T_n$, the message "RELEASE PLASTIC WRAP IF DRY" is announced. In this case, an address data X'1000' (a binary code '001000000000000') is applied to selected voice address signals $VS_{15}$ to $VS_0$.

Figure 8:
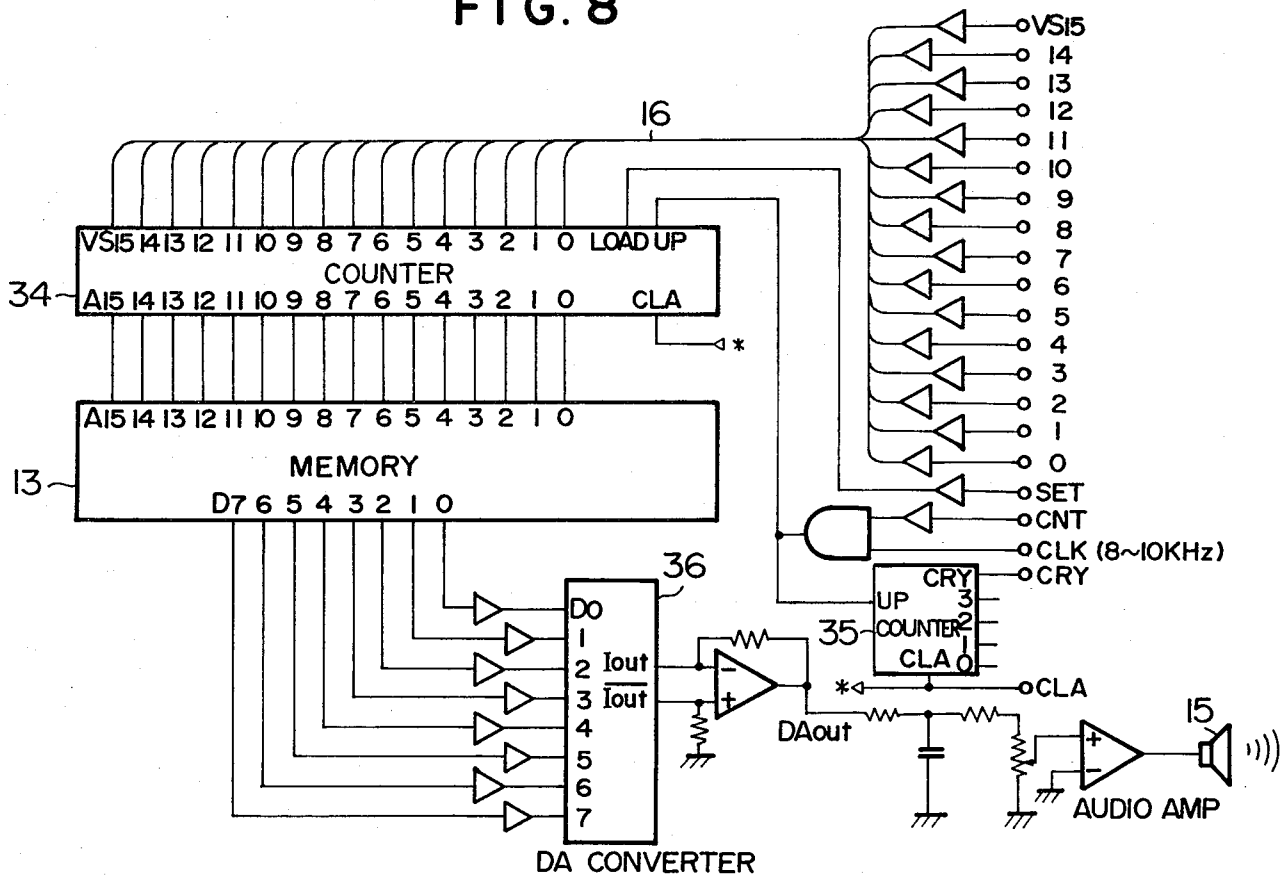
FIG. 8 is a circuit diagram of the voice synthesizer unit and associated parts in the apparatus according to the present invention.
Figure 9:
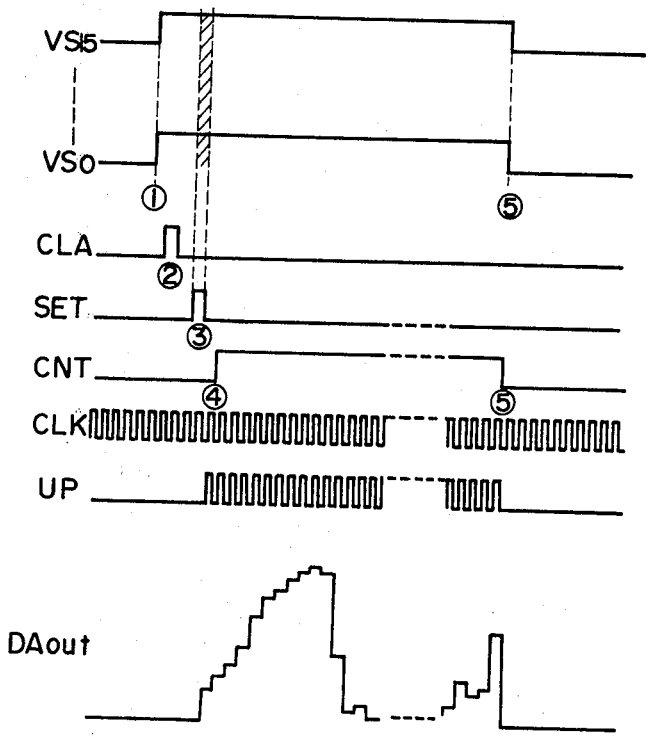
FIG. 9 is a timing chart of various control signals used in the apparatus according to the present invention.

These address signals are processed in the voice synthesizer unit 14 whose detailed structure is shown in FIG. 8. The address data is first preset in an address counter 34. FIG. 9 is a timing chart of voice information control signals. At time point ① of FIG. 9, the address signals $VS_{15}$ to $VS_0$ are applied from the microcomputer 29. At time point ② of FIG. 9, a clear signal CLA clears the address counter 34 and a word counter 35. At time point ③ of FIG. 9, a set signal SET is applied to preset the address signals $VS_{15}$ to $VS_0$ in the address counter 34. At time point ④ of FIG. 9, a count signal CNT is applied, and a clock signal CLK (of 8 to 10 kHz in this case) starts to be applied to the address counter 34 and word counter 35 to modify the addresses one after another, and voice data $D_7$ to $D_0$ appear from the memory 13. Such voice data $D_7$ to $D_0$ are converted into an analog signal by a D-A converter 36, and after being suitably amplified and re-shaped, the analog signal is reproduced into the voice information by the speaker 15. It will thus be seen that the voice data obtained by sampling the human voice at the frequency of 8 to 10 kHz and then quantizing the results of sampling are orderly arranged and stored in the voice data memory 13. In other words, according to the embodiment of the present invention, the human voice data recorded by the PCM method are stored in the voice data memory 13 and are reproduced by the same sampling frequency as that used for recording so as to reproduce the original voice.

Figure 10:
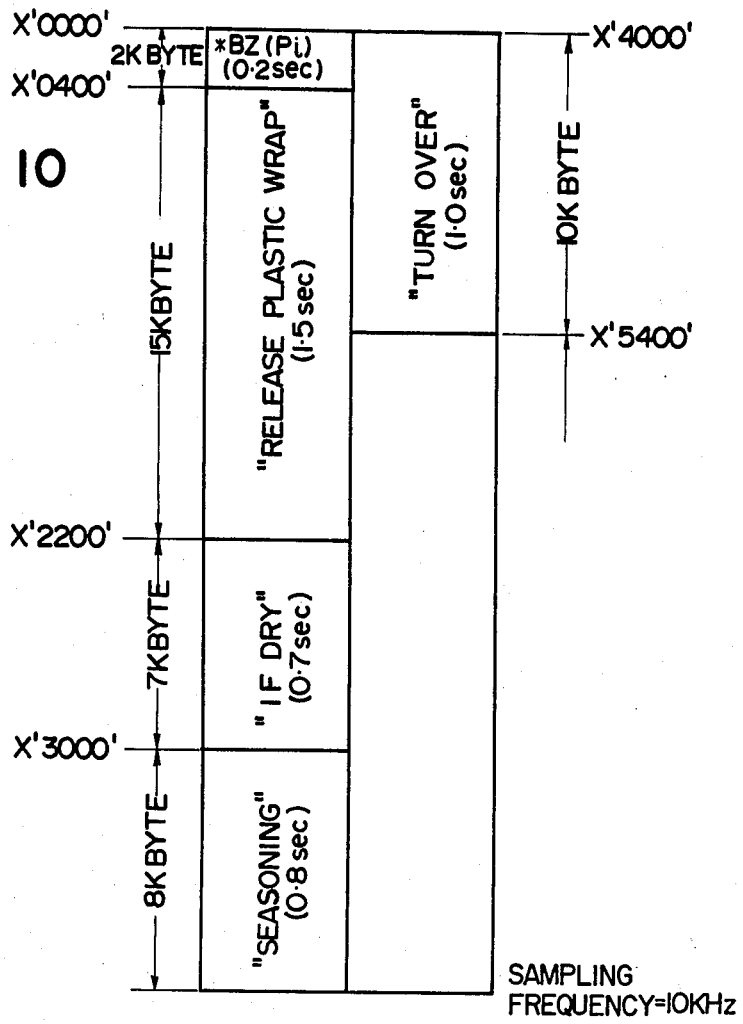
FIG. 10 is a memory map of voice data used in the apparatus according to the present invention.

FIG. 10 shows a map of voice data stored in the voice data memory 13. The word counter 35 counts a count-up signal UP shown in FIG. 9 and generates a carry signal CRY after it has counted 10 or 16 pulses. The microcomputer 29 counts this carry signal CRY until the data end address X'2FFF' of the voice data is detected. Upon detection of the data end address, the count signal CNT turns into its low level from its high level, and the synthesis of the voice information is terminated. Therefore, the next voice data "TURN OVER" would not be subsequently reproduced.

The word counter 35 may be eliminated when the processing speed of the microcomputer 29 is far higher than the frequency of the signal UP. When, on the other hand, the latter is far higher than the former, a plurality of such word counters 35 may be connected in series. In fact, it is only necessary to design the system taking into account the fact that the processing speed of the microcomputer 29 is 1 to 20 μsec per processing instruction and that the period is 100 μsec when the frequency of the clock signal CLK is 10 kHz as in this embodiment. In the embodiment of the present invention in which only one scale-of-16 counter is provided, the frequency of the clock signal CLK is divided by the factor of 1/16, and the carry signal CRY has the frequency of 625 Hz and the period of 1.6 msec. Thus, even when the processing speed of the microcomputer 29 is as low as 20 μs/instruction, the carry signal CRY may only be counted once every 80 steps thereby alleviating the load on the microcomputer 29.

Figure 11:
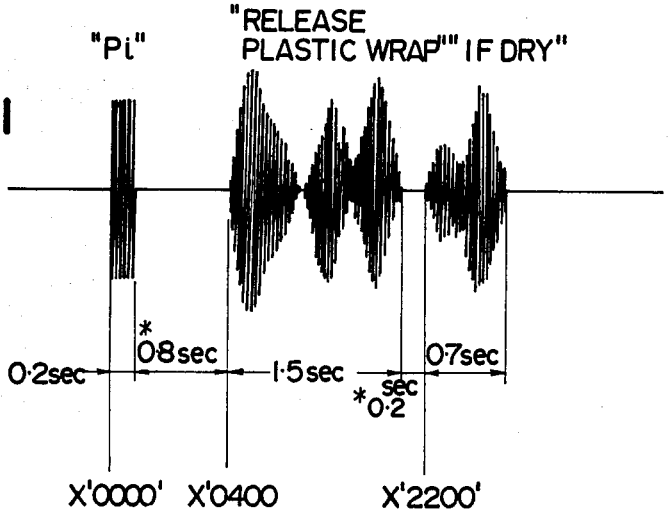
FIG. 11 is a waveform diagram of speaker outputs.

FIG. 11 shows outputs from the speaker 15, that is, reproduced voice messages. The steps of voice synthesis will be described with reference to FIG. 11. Suppose, for example, that the address data X'0000' is applied from the microcomputer 29, then, the audible alarm of sound "Pi" is heard for 0.2 second. When the data end of the alarm is detected, the counter or timer in the microcomputer 29 counts the clock pulses to provide a pause period of 0.8 second. This manner of pause period counting by the counter can save the capacity of the voice data memory 13. This is because the alarm sound need not be stored as a 1-minute data. Further, the storing of the pause period in the form of such a voice data is undesirable in that an irritating hiss noise such as a sound like whoosh encountered frequently during reproduction of a record from a magnetic tape, tends to be reproduced. Such an undesirable hiss noise can be completely eliminated by the provision of the pause timer.

Following the audible alarm, the address data X'0400' is applied from the microcomputer 29, so that the message "RELEASE PLASTIC WRAP" is reproduced for 1.5 seconds. In the embodiment of the present invention, the synthesis of voice information is then temporarily interrupted, and a pause period of 0.2 second is counted by the pause timer again. Subsequently, the address data X'2200' is applied to reproduce the message "IF DRY". Such short words or phrases are stored in succession in the voice data memory 13 for the reason that voice data requiring a large memory capacity can be efficiently used. The message "IF DRY" is also combined with other words so as to be utilized for the synthesis of other messages.

The address data outputs X'0000', X'0400' and X'2200' are stored, together with the data of the pause periods of 0.8 second and 0.2 second to be inserted between the respective address data, in the RAM part of the microcomputer 29. Each of these data is kept stored in the RAM part until the next new message is announced or until the message having been announced already becomes ineffective, so that the same message can be repeatedly announced whenever so required by striking the repeat key 10.

In a developed aspect of the present invention, the system structure may be such that not only the data "A3" is merely displayed on the display 5 in response to the depression of the key "AUTO 3", but also a menu or menus that can be cooked according to this specific heating sequence are announced by voice. For example, a message "MEAT MEDIUM" may be announced as soon as the data "A 3" is displayed on the display 5.

While an example of effective use of the humidity sensor has been described in the embodiment of the present invention, other sensors can also be utilized for the heating sequence control purpose by similarly compensating for their weak points and announcing messages including instructions of their efficient use, so that a more perfect, automatic high-frequency heating apparatus can be realized.

When the apparatus is adapted to be also controlled on the basis of the temperature sensed by a temperature probe 38, it may be sufficient to provide a "TEMP" key 38 and to announce a message "INSERT PROBE" in response to the selection of the "TEMP" key. A message "REMOVE PROBE" may be advised when the user is going to carry out automatic cooking on the basis of the information from the humidity sensor 20 while leaving the temperature probe in the inserted position. A "WEIGHT" key may also be provided so as to give a finer advice depending on the weight of a foodstuff such as meat. In such a case, the user may be advised to insert the temperature probe 39 into a lower central portion of the meat when the weight is 5 pounds, and into a central portion of the meat when the weight is 1 pound.

Figure 12:
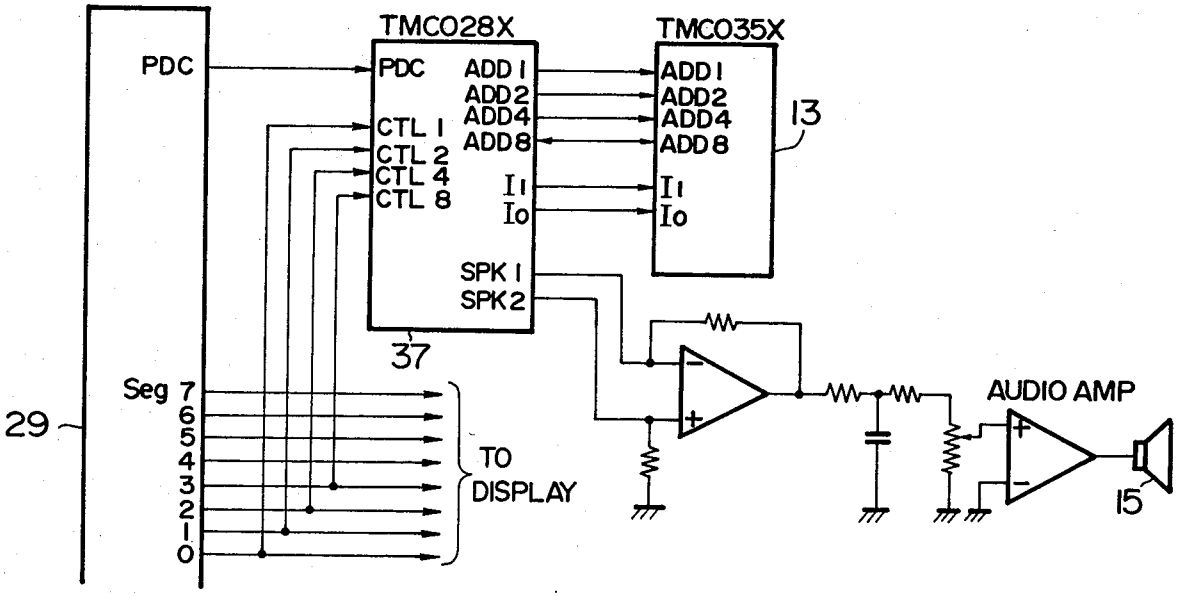
FIG. 12 is a circuit diagram of another form of the voice synthesizer unit and associated parts in the apparatus according to the present invention.

The aforementioned embodiment of the present invention has based on the utilization of reproduction of voice data recorded by the PCM method. Actually, however, the PCM method requires a very large memory capacity which provides a hindrance to mass production. Therefore, various techniques for data compression and synthesis are now proposed, and an attempt to employ an LSI structure in a part of the voice synthesizer unit, is now proposed. The PARCOR synthesis method is one of such methods for voice analysis and synthesis and has attracted the attention of those skilled in the art since the rate of data compression is high and the quality of synthesized voice is also high. FIG. 12 shows a modification of the aforementioned embodiment of the present invention in which such an LSI is employed for the PARCOR synthesis. The circuit structure shown in FIG. 12 is entirely similar to that shown in FIG. 7 except for the voice synthesizer unit, and any detailed description of similar parts is therefore unnecessary.

Figure 13:
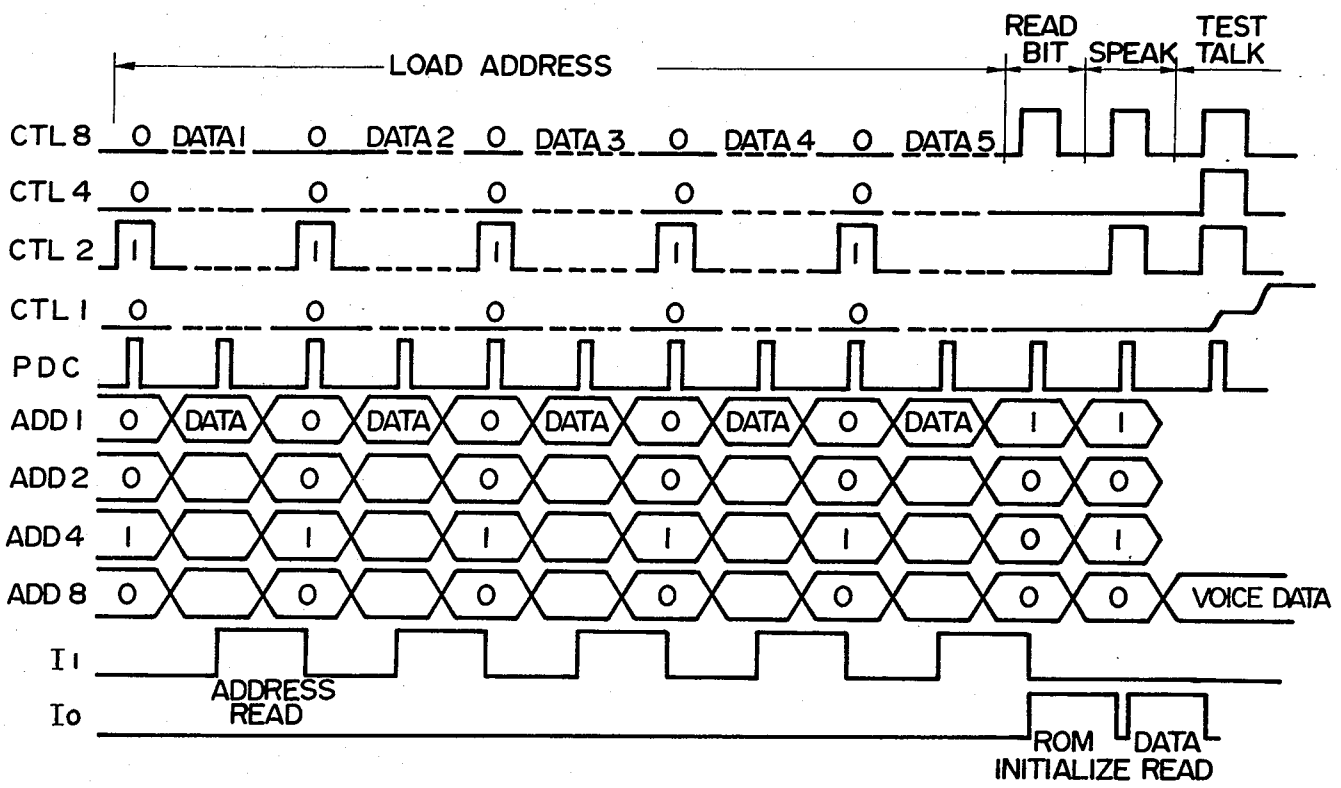
FIG. 13 is a timing chart showing the operation of the voice synthesizer unit shown in FIG. 12.

Referring now to FIG. 12, the system includes a voice synthesizer 37 LSI structure which is a PARCOR synthesizer model TMCO28X manufactured by the TI Corporation in the U.S.A. In lieu of providing exclusive output ports like those shown in FIG. 8, the segment signals $Seg_3$ to $Seg_0$ among $Seg_7$ to $Seg_0$ used for data display are utilized to provide address data. Therefore, a timing means for setting the address data is provided so that, after the data is displayed on the display 5, the segment signals $Seg_3$ to $Seg_0$ apply the required address data to the input ports $CTL_1$ and $CTL_8$ of the synthesizer 37 in response to a control signal PDC appearing from the microcomputer 29. FIG. 13 is a timing chart of various signals appearing in FIG. 12. The address data divided into five parts is preset in a manner as shown by "LOAD ADDRESS" in FIG. 13.

The decoded address data is applied to input ports $ADD_1$ to $ADD_8$ of the voice data memory 13 to be loaded in the voice data memory 13 in response to a signal $I_1$.

Upon completion of the loading of the address data, reading of the voice data from the voice data memory 13 starts in response to a signal $I_0$. The individual bits of the voice data appear one after another on the port $ADD_8$ to be written in the synthesizer 37. Such data is a parameter for actuating the synthesizer 37 and is extracted by analyzing the voice.

This parameter is processed in the synthesizer 37 and appears as electrical voice signals $SPK_1$ and $SPK_2$ from the synthesizer 37. These signals $SPK_1$ and $SPK_2$ are equivalent to the outputs $I_{out}$ and $\overline{I_{out}}$ of the D-A converter 36 shown in FIG. 8. The signals $SPK_1$ and $SPK_2$ are then to re-shaping and amplification to be reproduced as a message which is announced from the speaker 15.

Figure 14:
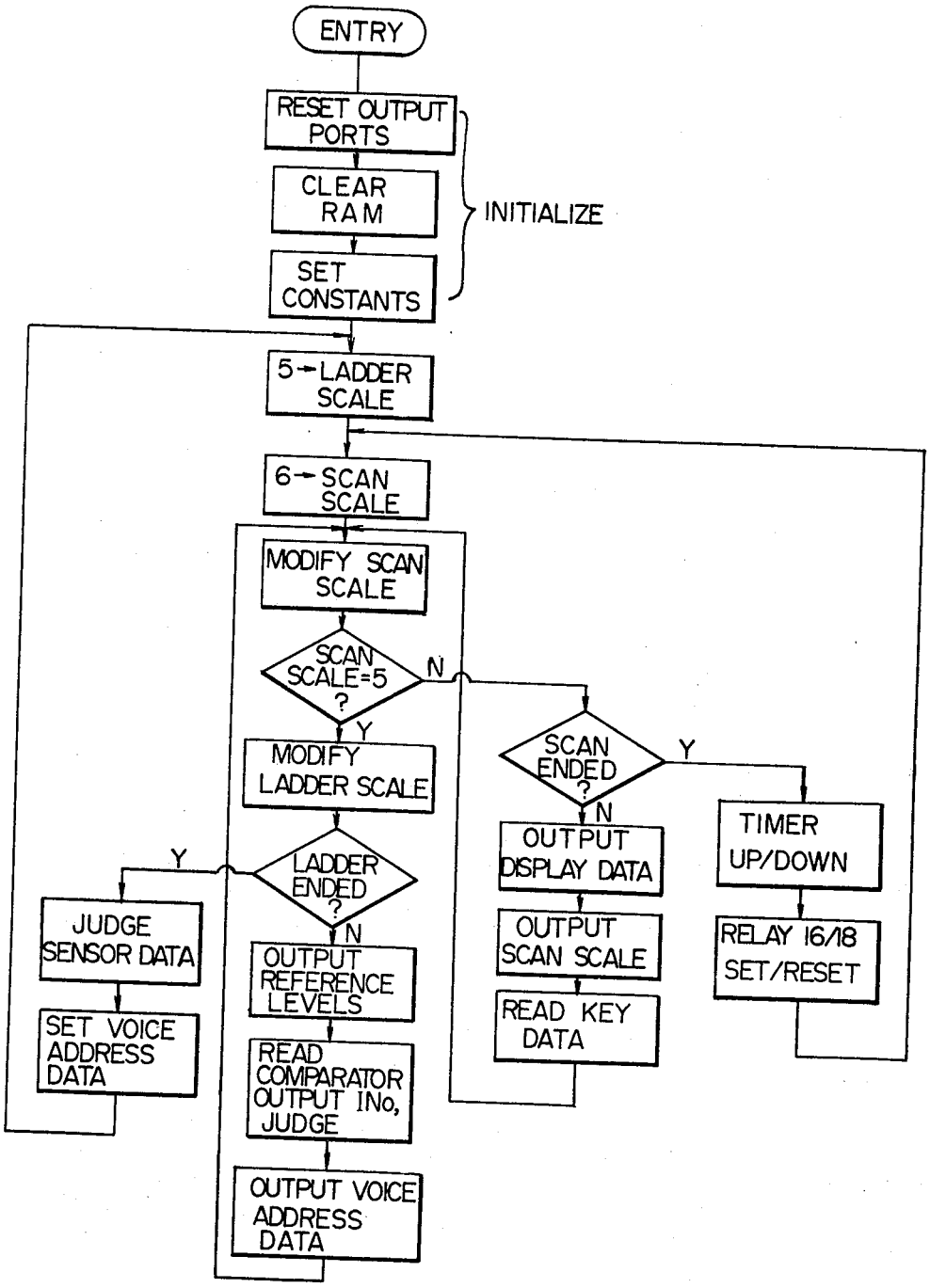
FIG. 14 is a flow chart showing an outline of the heating sequence control according to a microcomputer program, by way of example.

FIG. 14 is a flow chart for carrying out such a heating sequence control and is stored in the ROM part of the microcomputer 29. Briefly describing, the program starts from entry. In the first step, all the output ports of the microcomputer are reset, and the RAM is then cleared. In the second step, predetermined constants are loaded in predetermined addresses of the RAM. The above steps initialize the microcomputer.

Subsequently, 5 is preset in the ladder output register in the RAM, and 6 is preset in the scan output register in the RAM. These figures are then decreased in the succeeding steps of scan output modification and ladder output modification to provide basic data used for operating the system in time sharing fashion.

The timing controlled by the scan output is classified into six periods of from period 5 to period 0. In the period 5, no display operation is performed, and the reference signals $Ref_4$ to $Ref_0$ for setting the reference level used for comparison with the sensor data are applied from the microcomputer. Five periods of from period 4 to period 0 are allotted to meet the output of the ladder output register.

In the successive scanning periods, the individual bits of the reference level are sequentially applied to the switching unit 32 in the order of from the most significant bit $Ref_4$ to the least significant bit $Ref_0$, and the output $IN_0$ of the comparator 31 at that time is judged. In this manner, all the bits of the sensor data are compared with the corresponding bits of the reference level by the bitwise setting and resetting. In the 6th scanning period, the ladder modification is completed, and the sensor data is judged to estimate the state of progress of the heating sequence. When so required, the predetermined voice address data are set in the RAM at that time so that they can be sequentially read out from the RAM in the succeeding scanning periods as shown in FIG. 13.

In the periods 4 to 0, the display 5 provides a dynamic display. That is, the segment signals $Seg_7$ to $Seg_0$ apply the data to be displayed, and the display segments corresponding to the predetermined digits are then energized. At the same time, the key matrix 11 is scanned with the scanning signals $SC_4$ to $SC_1$ to read the key data.

Upon completion of the above manner of display and key data processing, the timer means starts to count up or down, and the relays in the heating duration control unit 16 and high-frequency output control unit 18 are set or reset. Then, the program returns to the beginning of the scan routine again.

The outline of the microcomputer program will be understood from the above description.

What is claimed is:

1. A heating apparatus having a plurality of sensors comprising:

a heating chamber adapted to receive a substance to be heated therein, heating means for supplying heat toward and into said heating chamber, sensor means including at least first and second sensors of said plurality of sensors for respectively sensing two different items of physical data independently representing the heating condition of said substance, a main control unit including a ROM, said main control unit estimating the state of progress of a heating sequence for said substance by comparing the physical data sensed by either said first sensor or said second sensor means with a reference level stored in said ROM, timer means for counting clock pulses applied to said main control unit, a heating duration control unit controlled by said main control unit in accordance with the outputs from said sensor means and said timer means for controlling the power supplied to said heating means, a heating control unit for varying the output of said heating means, a manipulator panel including an automatic cooking select key and a temperature setting key, wherein when said automatic cooking select key is depressed said first sensor is selected and when said temperature setting key is depressed said second sensor is selected, and a semiconductor voice synthesizer unit for reading out voice data from a semiconductor voice data memory in accordance with address data entered from said main control unit and for synthesizing the read-out voice data into corresponding voice information, said main control unit outputting said address data so that appropriate voice data including warning signals and other information required for proper use of said heating apparatus and inherent to the selected first or second sensor is read out.

2. A heating apparatus according to claim 1, wherein said voice data memory stores a periodic alarm sound data therein so that the address of this alarm sound can be applied prior to the synthesis of the voice information from the voice data selected for said heating sequence, and said timer means starts to count a silent pause period as soon as the data end of the alarm is detected, so that the address of the voice data selected for said heating sequence can be applied after said pause period.

3. A heating apparatus according to claim 1 which further comprises a RAM, and wherein a first of said plurality of sensors is fixed to said heating apparatus and a second of said sensors is removable from said heating apparatus, depression of one of said automatic cooking select keys presets in said RAM a heating sequence corresponding to said key and stored in said ROM, and selection of a heating sequence using said first sensor followed by insertion of said second sensor in said heating apparatus initiates an announcement by said voice synthesizer advising that said second sensor should be removed.

4. A heating apparatus according to claim 3, wherein said first sensor includes a humidity sensor and said second sensor includes a temperature probe.

5. A heating apparatus according to claim 1, wherein at least one of said plurality of sensors is a removable temperature probe, and wherein depression of said temperature setting key without insertion of said temperature probe initiates an announcement by said voice synthesizer advising that said temperature probe should be inserted.

6. A heating apparatus according to claim 1, wherein at least one of said plurality of sensors is a humidity sensor, and wherein depression of one of said automatic cooking select keys initiates an announcement by said voice synthesizer advising that said substance to be heated should be wrapped.

* * * * *